United States Patent [19]

Pozzi et al.

[11] Patent Number: 4,982,875

[45] Date of Patent: Jan. 8, 1991

[54] CAP, RESERVOIR AND DROPPER ASSEMBLY FOR BOTTLES

[75] Inventors: Franco Pozzi, Como; Angelo Carenzi, Busto Arsizio VA, both of Italy

[73] Assignee: Zambon S.p.A., Vicenza, Italy

[21] Appl. No.: 892,909

[22] Filed: Aug. 1, 1986

[30] Foreign Application Priority Data

Aug. 2, 1985 [IT] Italy ..... 21845A/85

[51] Int. Cl.[5] ..... B65D 47/18; A61M 37/00

[52] U.S. Cl. ..... 222/83; 222/420; 604/87; 604/416

[58] Field of Search ..... 222/420, 83, 91, 83.5; 604/87, 88, 415, 416

[56] References Cited

U.S. PATENT DOCUMENTS 3,802,604 4/1974 Morane et al. ..... 222/83

3,968,872 7/1976 Cavazza ..... 222/83 X

FOREIGN PATENT DOCUMENTS 0428093 7/1967 Switzerland ..... 604/87

*Primary Examiner*—H. Grant Skaggs

*Assistant Examiner*—Steven M. Reiss

*Attorney, Agent, or Firm*—Cushman, Darby & Cushman

[57] ABSTRACT

The cap reservoir and dropper assembly for bottles includes a reservoir (1) fitted with a collar 913) adapted for resting on the mouth of a bottle (4), a delivery piston (2) the lower part of which is shaped like a flute mouthpiece (24) and the upper part of which is shaped like a collar (22). The assembly further includes a cap (3) the lower part of which is in the form of a removable strip (33). The delivery piston is equipped in its upper part with a dropper (23). The cap may be equipped with a feature which cooperates with the delivery piston collar to push the delivery piston downwards.

2 Claims, 2 Drawing Sheets

CAP, RESERVOIR AND DROPPER ASSEMBLY FOR BOTTLES

BACKGROUND OF THE INVENTION

This invention relates to a reservoir cap with a dropper, for bottles, in particular for extemporaneous solutions of pharmaceutical products.

It is known that some drugs are not stable in aqueous medium.

In this case the solution is prepared extemporaneously thus reducing the time of contact of the drug with the aqeuous medium to the 7- to 15-day period during which treatment lasts and is sufficiently limited to not noticeably endanger the stability of the drug.

Known containers for preparing extemporaneous solution are very complicated and costly, especially in the case of solutions for ophthalmic use, and only rarely ensures sterility of the solution. Indeed, they consist of (i) a bottle containing the drug in the form of sterile powder or granules (ii) a second bottle or a vial containing the sterile aqueous solution, and (iii) a third sterile container containing a dropper.

At the time of use the bottle containing the powder and the vial containing the solution are opened and the latter is poured into the bottle. This pouring is less simple that it might seem because the bottle mouths are rather small and the vial mouths are still smaller. In addition, in many cases the patient who is to perform the operation is elderly and has unsteady hands and/or his sight is rather poor. The easy loss of the aqueous solution causes the pharmaceutical solution thus obtained to be more concentrated than expected and this changes the dosage of the drug.

In addition the numerous manual operations required easily comprise the sterility of the solution and the dropper.

In the case of single-dose drinkable solutions and extemporaneous syrup there is known the use of reservoirs which contain a powder and are fitted on the mouth of the bottle containing the aqueous solution into which the powder is then dropped by breaking or opening the reservoir. The reservoir is then removed and discarded. In the case of single-dose solutions the content is promptly drunk and the container is discarded as well. In the case of syrup a cap is applied to the bottle mouth.

A reservoir cap not removed after preparation of the extemporaneous solution and also functioning as a dispenser of the solution and in particular as a dropper has never been made heretofore.

SUMMARY OF THE INVENTION

The object of this invention is a cap, reservoir and dropper assembly, easy to apply and use of extemporaneous solutions which would also allow preparation of the solution, without pouring from one bottle to another and without the operator having to handle the dropper, thus ensuring both sterility of the solution and accurate dosage of the drug, because the obtained solution is sure to have the desired concentration.

This has been achieved by means of a cap, reservoir and dropper assembly for bottles comprising a reservoir fitted with a collar adapted for resting on the mouth of a bottle, a delivery piston the lower part of which is shaped in the form of a flute mouthpiece and the upper in the form of a collar and a cap the lower part of which is in the form of a removable strip and is characterized in that the delivery piston is equipped in its upper part with a dropper. In addition the cap may be equipped with means which cooperate with the delivery-piston collar to push said delivery-piston downward.

BRIEF DESCRIPTION OF THE DRAWINGS

These and other features and advantages will appear clearly to those skilled in the art from this description and from the annexed drawings which illustrate one embodiment of the present invention and wherein.

DETAILED DESCRIPTION

Figure 1:
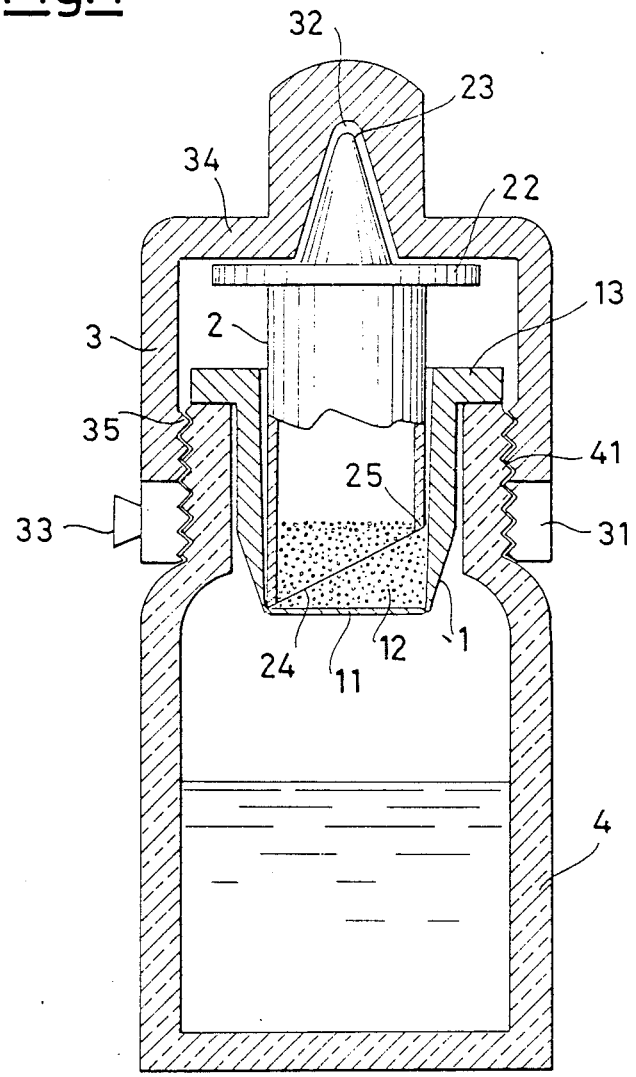
FIG. 1 is a longitudinal section of the cap, reservoir and dropper assembly mounted on a bottle as it appears before preparation of the solution.
Figure 2:
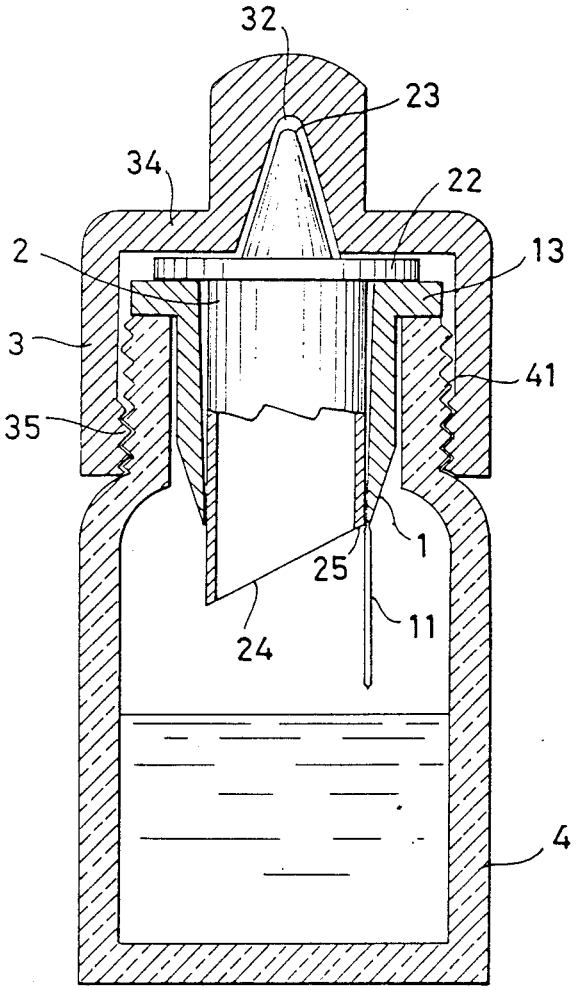
FIG. 2 is a view similar to that shown in FIG. 1 but showing the position in which the cap, reservoir and dropper assembly is found after preparation of the solution.

As may be seen in FIG. 1 a reservoir 1 containing granules or a powder 12 rests on the mouth of the bottle 4 by means of a collar 13.

Within this reservoir is placed a delivery piston 2 consisting of a hollow cylindrical body the lower part of which is shaped like a flute mouthpiece 24. The upper part of said delivery piston is fitted with a collar 22 and a dropper 23 having a tip in which a dispensing opening is formed or can be formed.

On the threaded neck 41 of the bottle 4 is then housed a cap 3 with threads 35 fitted with a tear-off strip 31 which acts as a retainer and a seal of guarantee and which is made integral with the bottle neck by known means (not shown); the upper part of the cap 3 has meamns 34 which can exert uniform pressure on the collar 22 and is shaped in such a manner that a recess 32 houses the dropper 23.

Preferably the upper part of the recess 32 is provided with a small protrusion (not shown) which closes the opening of the dropper thus preventing the solution to flow out when the bottle is put in a pocket or a bag.

The bottle 4 can be made of a rigid material such as glass or polypropylene or a semirigid material such as polyethylene.

The reservoir is preferably made of a semirigid material such as polyethylene and on the circumference of the bottom 11 the thickness thereof is much reduced so as to form a weakened line.

The body of the delivery piston is preferably made of a rigid material such as polypropylene and of a rigid or semirigid material in its upper part in the form of a dropper 23; in addition the lower part in the form of a flute mouthpiece is shaped in such a manner as to have a cutting edge appropriately incised or perforated to allow delivery of all the solution contained in the bottle.

The cap 3 may be made of a rigid or semirigid material. The tear-off strip 31 is connected to the cap body by connecting tabs (not shown) which facilitate removal thereof.

During packaging the powder or granules 12 are metered into the reservoir 1 on which is then mounted the delivery piston 2 and the assembly may be sterilized when necessary by usual methods.

This assembly is then mounted on the bottle 4 into which the solution was previously metered. Finally, the cap 3 is applied and the container thus prepared may be sterilized if necessary.

All the filling and sterilization operations may be performed using conventional techniques and machines.

At the time of use the tear-off strip or guarantee seal 31 is torn off. This operation is facilitated by the presence of a tongue 33.

The tear-off strip 31 also acts as a retainer since its height is the same as that separating the lower wall of the collar 22 from the upper part of the collar 13. Once the guarantee seal 31 has been torn off the cap can be screwed down further.

During this operation the means 34 press on the collar 22 of the delivery piston 2 which, thanks to the lower part shaped in the form of a flute mouthpiece 24, cuts and detaches almost completely the bottom 11 of the reservoir, being facilitated therein by the weakening along the circumference of the bottom 11. Only the part at the highest point 25 of the flute mouthpiece is not cut, thus preventing the bottom 11 of the reservoir 1 from falling into the solution.

The granules or powder 12 fall into the solution, in this manner forming the desired pharmaceutical solution of suspension.

At the same time the dropper becomes functional, resting its collar 12 on the collar 13 of the reservoir.

At this point operation of the dropper bottle in accordance with the present invention is fully equivalent to that of dropper bottles of the type commonly used for stable pharmeceutical solutions.

In the illustrated embodiment the cap 3 is screwed onto the neck of the bottler but it may be made to fit under pressure alone.

The part 34 of the cap which functions together with the collar 22 to push the delivery piston downward is illustrated in a flat form but it may be in any other form provided it be capable of performing the required function.

When required the cap may be shaped in the form of a childproof cap of a known type.

The dropper is preferably made tight when it is desired to fill the reservoir with a liquid which will be mixed with the liquid contained in the bottle when the bottom 11 of the reservoir is cut; in this case a sharp protrusion (not shown) located in the upper part of the recess 32 pierces the upper part of the dropper when the cap 3 is pressed on the collar 22 and the latter rest on the collar 13.

Other embodiments can be easily made without departing from the inventive idea illustrated above.

What is claimed is:

1. A cap, reservoir and dispensing dropper assembly for a bottle comprising:

a reservoir having a first end portion adapted to fit within the opening in a bottle and having a second end forming a collar adapted to rest on the mouth of the bottle, the first end of the reservoir being closed by a closure wall and the second end being open;

a hollow piston slidably fitted in the open end of the reservoir, the piston having a first end adapted to cut said closure wall when forced against the latter and having a second end fitted with a dropper;

a cap having a side wall adapted to releasably connect with the exterior of the neck of the bottle and an imperforate end wall which overlies the second end of said piston, whereby said dropper is protected from contamination when said assembly is connected to the bottle by said cap;

said second end of said piston including a circumferential collar;

said side wall of said cap being internally threaded so as to be threadedly engaged with external threads on a bottle neck; and said cap having an internal surface which, upon screwing of said cap on to the bottle a predetermined distance, engages said piston collar and forces the piston in a direction to cut said closure wall, the arrangement being such that further tightening of said cap forces said piston collar into sealing engagement with said reservoir collar.

2. An assembly as in claim 1 wherein said cap side wall includes a removable strip having a width equal to the distance between said piston collar and said reservoir collar.

* * * * *